US008616904B1

(12) United States Patent
Martin et al.

(10) Patent No.: US 8,616,904 B1
(45) Date of Patent: Dec. 31, 2013

(54) PLUG-RETAINING RECEPTACLE

(75) Inventors: Larry W. Martin, Cupertino, CA (US); John Gee Tang, Redwood City, CA (US)

(73) Assignee: Amazon Technologies, Inc., Reno, NV (US)

( * ) Notice: Subject to any disclaimer, the term of this patent is extended or adjusted under 35 U.S.C. 154(b) by 330 days.

(21) Appl. No.: 13/076,224

(22) Filed: Mar. 30, 2011

(51) Int. Cl.
*H01R 29/00* (2006.01)

(52) U.S. Cl.
USPC ..... 439/188

(58) Field of Classification Search
USPC ..... 439/188, 346–347, 134, 620.29, 736, 439/368–371, 518, 651, 263; 200/43.02, 200/43.08, 51.12
See application file for complete search history.

(56) References Cited

U.S. PATENT DOCUMENTS

| | | | | |
|---|---|---|---|---|
| 3,691,327 | A * | 9/1972 | Chesler | 200/43.02 |
| 6,884,125 | B2 * | 4/2005 | Chen | 439/848 |
| 7,753,721 | B1 * | 7/2010 | Wu | 439/518 |
| 2005/0153592 | A1 * | 7/2005 | O'Keefe et al. | 439/346 |
| 2008/0081494 | A1 * | 4/2008 | Larsen et al. | 439/134 |

* cited by examiner

*Primary Examiner* — Edwin A. Leon
(74) *Attorney, Agent, or Firm* — Lee & Hayes, PLLC

(57) ABSTRACT

A receptacle may include a locking mechanism for retaining a plug in a mated condition. For example, the locking mechanism may engage with a hole formed in at least one prong of the plug. The locking mechanism may include at least one locking pin that moves to a retracted position during insertion of the plug into the receptacle, and that moves to an engaged position when the hole in the prong aligns with the locking pin. In some implementations, an electrical connection is not formed until the locking pin at least begins to engage with the hole in the prong. In some instances, an electrical contact may move into electrical connection with the prong as the locking pin engages with the hole in the prong. Furthermore, in some implementations, the receptacle may be included in a plug adapter for securely mating a plug with the plug adapter.

32 Claims, 14 Drawing Sheets

PLUG-RETAINING RECEPTACLE

BACKGROUND

People commonly form an electrical connection by inserting the metal blades or prongs of a plug into a matching socket or receptacle. However, sometimes a person may not fully insert the plug into the receptacle. Thus, even though the prongs of the plug may be inserted far enough into the receptacle to form an electrical connection, the prongs may remain partly exposed. In other cases, the plug may be unintentionally partially pulled out of the receptacle. When the plug is not fully inserted or is partially pulled out of the receptacle, the exposed prongs of the plug may present a shock or fire hazard. For example, should a person or object accidentally contact the exposed prongs, electric current may pass into the person or object. Further, prolonged contact with the exposed prongs may result in a fire. In addition, if the plug is unintentionally pulled entirely out of the receptacle, the electrical connection is severed, which can have its own undesirable consequences.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Electrical Connections

Figure 1:
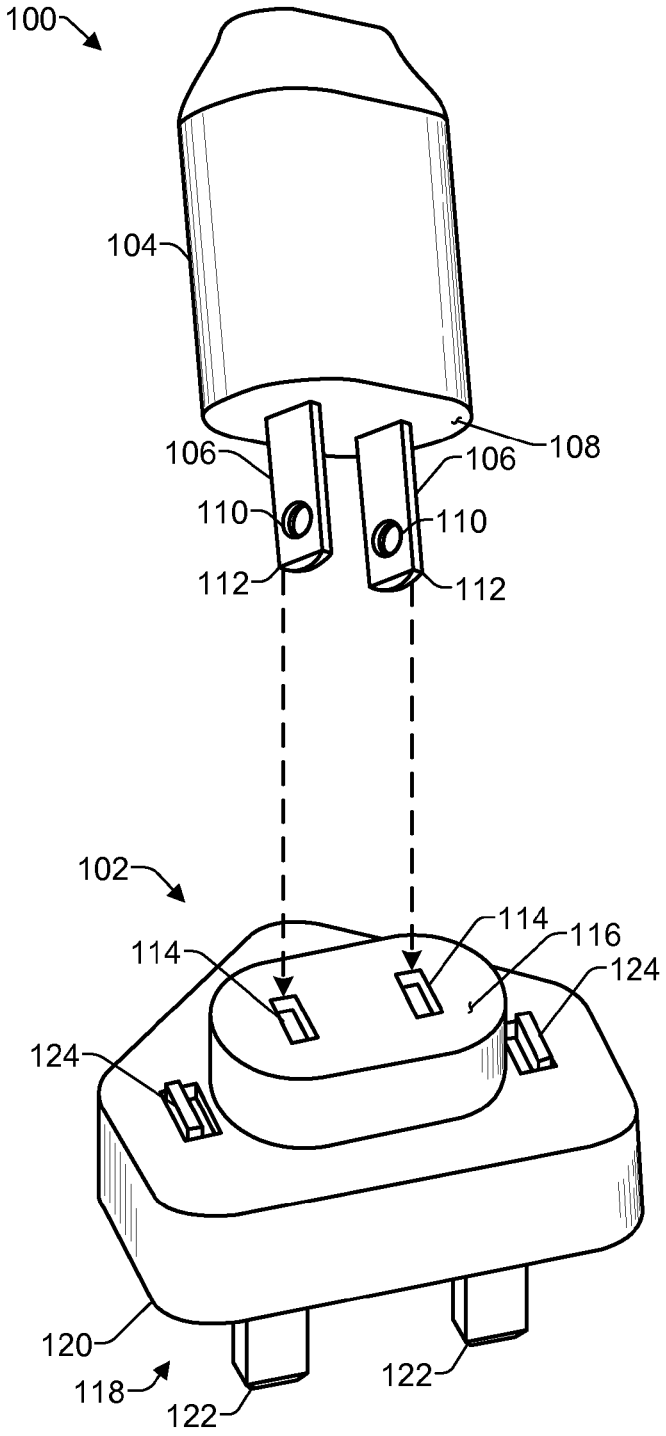
FIG. 1 is a perspective view of an example plug and receptacle according to some implementations.

This disclosure includes arrangements and techniques for forming an electrical connection. In some implementations, when the prongs of a plug are inserted into a receptacle, a locking mechanism in the receptacle may retain the plug in a mated condition with the receptacle. For example, the receptacle may include at least one locking pin that engages with a hole in at least one prong of a plug that is mated to the receptacle. The at least one locking pin may prevent or restrict the plug from being disconnected from the receptacle until an action is taken to unlock or release the plug. In some instances, an electrical connection is not formed until the prongs of the plug are fully inserted into the receptacle. For example, in some implementations, the electrical connection is not formed until at least one locking pin has entered a hole in at least one prong. Thus, some implementations prevent partial insertion of the plug prongs.

Additionally, when a user takes action to release the plug from the receptacle, the electrical connection may be severed, thereby preventing partially exposed prongs from carrying electric current. For example, in some implementations, the electrical connection may be severed as at least one locking pin is disengaged from the hole in the prong. Further, in some implementations, the electrical connection may be severed before the locking pin is entirely removed from the hole in the prong.

In some implementations, the plug may be a standard North American plug type (e.g., a National Electrical Manufactures Association "NEMA" type A or type B plug) having at least one hole in one or more of the blades or prongs to be plugged into the receptacle. For example, in some implementations, the plug may be a NEMA 1-15 polarized or unpolarized plug, a NEMA 5-15 plug, a NEMA 5-20 plug, or other type of plugs that are conventionally non-locking plug types.

In some implementations, the receptacle may be included as part of a plug adapter. Thus, the locking mechanism in the receptacle may retain the plug adapter in a mated condition with the plug. For example, the plug adapter may include blades or prongs having a different configuration from the prongs of the plug, such as to enable connection to a wall socket having a different outlet configuration from the plug. For instance, as a few examples of various different plug-and-socket configurations, many European countries typically use a Type C, E, or F plug having two round prongs; India typically uses a Type D plug having three round prongs; the United Kingdom typically uses a Type G plug having three rectangular prongs; Australia typically uses a Type I plug having two or three blades in a V-shape. These types of sockets are not able to receive a conventional North American plug.

Accordingly, in some implementations, a plug adapter may be configured to receive a plug to enable connection of the plug to a different type of socket configuration. When the plug is inserted into or mated with the adapter, the plug may be locked or otherwise retained in the mated condition, so that user action, other than merely pulling on the plug, is required to unmate the plug from the receptacle. Further, according to some implementations, an electrical connection between the plug and plug adapter is not completed until the prongs of the plug are fully inserted and/or locked in position in the receptacle. Additionally, while in some implementations the receptacle is described in the context of being included in a plug adapter, in other implementations, the receptacle may be included in an extension cord, a wall outlet, an electronic device, a power strip, or other electrical receptacle location. Accordingly, implementations are not limited to any particular location or application of the receptacles disclosed herein. In addition, the plugs and receptacles described herein are not limited to transferring power but may also be used for transferring data, data packets, carrier waves, and other forms of electrical signals.

The foregoing discussion is provided for the reader's convenience and is not intended to limit the scope of the claims or the disclosure herein. Furthermore, the arrangements and techniques described above and below may be implemented in a number of ways and in a number of contexts. Several example implementations and contexts are provided with reference to the figures, as described below in more detail. However, the following implementations and contexts are but a few of many.

Push Engagement Examples

FIG. 1 is a perspective view of an example plug 100 and receptacle 102 according to some implementations. In the illustrated example, the plug 100 includes a plug body 104 having a pair of parallel blades or prongs 106 extending from a mating face 108. At least one of the prongs 106 may include a prong hole 110 formed through the prong 106 near a distal end 112 of the prong 106. Conventionally, prong holes 110 are formed in both prongs 106 of many plugs produced for use in North America. Further, in some implementations, the plug 100 may include polarized prongs 106 in which one of the prongs 106 is of a greater width than the other prong 106. Additionally, in some implementations, the plug 100 may be a Type B plug that also includes a third prong as a ground prong (not shown in FIG. 1) that also extends outward from mating face 108. Furthermore, in some implementations, the plug body 100 may enclose a transformer or other circuitry configured to transform an incoming current from a first amperage and/or voltage to a second amperage and/or voltage. However, in other implementations, the plug 100 may be a standard North American type A or type B plug with no additional circuitry.

The receptacle 102 may include a pair of apertures 114 that form openings in a receptacle mating face 116. The apertures 114 are configured to receive the prongs 106 of the plug 100 when the plug 100 is connected to or mated to the receptacle 102. In the illustrated implementation, the receptacle 102 may be included as part of or may be contiguous with a plug adapter 118 having an adapter body 120. The plug adapter 118 may include a plurality of blades or prongs 122 extending from the adapter body 120. For example, the prongs 122 of the plug adapter 118 may be of a different configuration for mating with a different type of receptacle from the plug 100 and the receptacle 102. Further, in other implementations discussed below, instead of a plug adapter, the receptacle 102 may be included in or used in an extension cord, a power strip, a wall outlet, an electronic device, or any other suitable location. Accordingly, implementations herein are not limited to the receptacle 102 being included in a plug adapter.

In the illustrated implementation of FIG. 1, the receptacle 102 includes one or more release buttons or release controls 124. For instance, following insertion of the prongs 106 into the apertures 114 of the receptacle 102, the release controls 124 may be actuated by a user for releasing the plug 100 from the receptacle 102. Thus, the release controls may disengage the locking mechanism for releasing the plug 100 to enable removal of the plug 100 from the receptacle 102.

Figure 2:
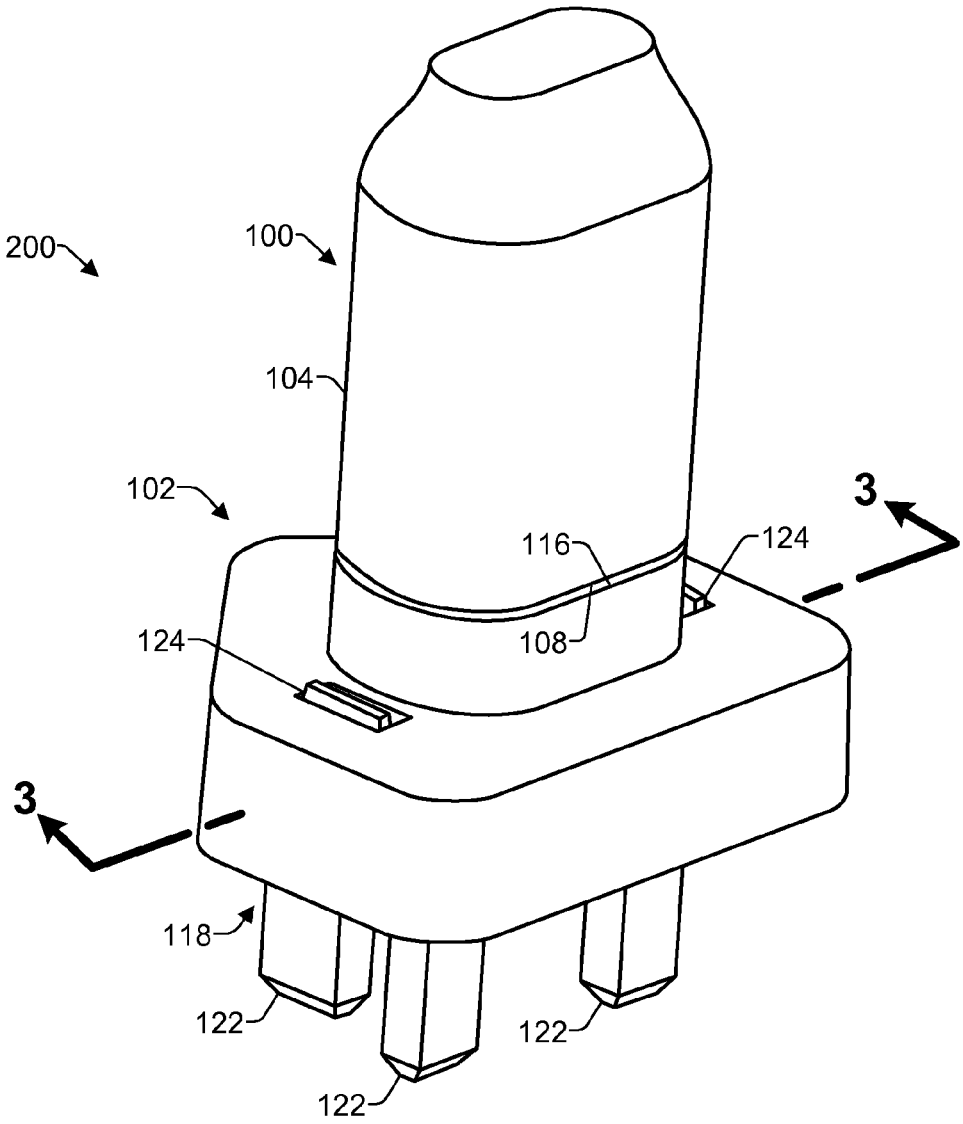
FIG. 2 is a perspective view of the plug inserted into the receptacle of FIG. 1.

As illustrated in FIG. 2, the plug 100 may be connected to or mated to the receptacle 102 by inserting the prongs 106 into the apertures 114 to achieve a mated condition 200. When the prongs are fully inserted into the apertures 114 in the mated condition 200, the mating face 108 of the plug 100 is positioned closely adjacent to or in contact with the receptacle mating face 116 so that external contact with prongs 106 is unlikely or not possible. Further, a locking mechanism in the receptacle 102, described additionally below, retains the plug 100 in the mated condition 200 with the receptacle 102 and, thus, with the plug adapter 118. In some implementations, when the plug 100 and receptacle 102 are in the mated condition 200, an attempt to pull the plug 100 out of the receptacle 102 is prevented by the locking mechanism. In the illustrated implementation, for a user to remove the plug 100 from the receptacle 102, the user may actuate or move the release controls 124 to release the locking mechanism, as described additionally below.

Figure 3:
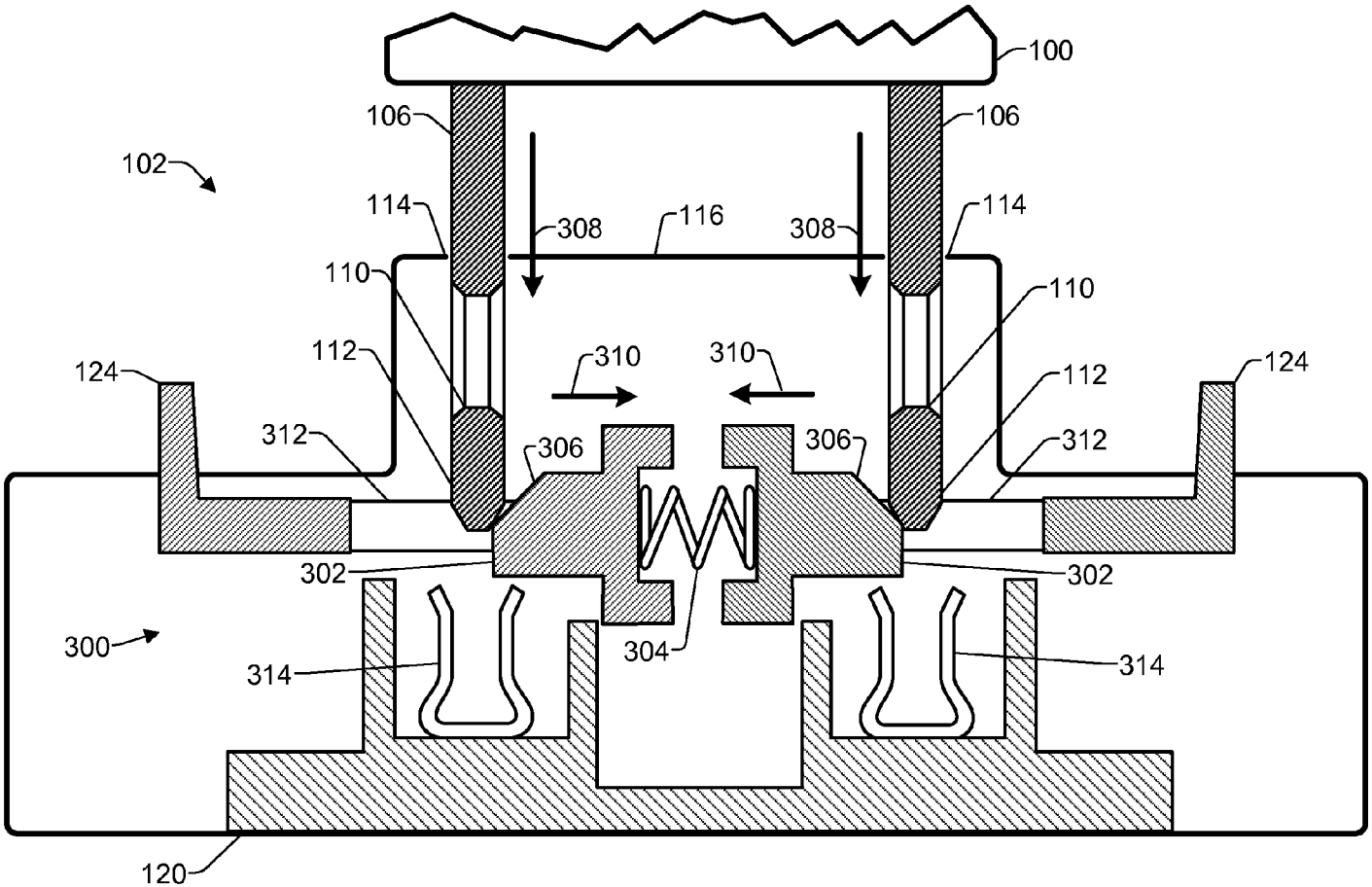
FIG. 3 is an enlarged cross-sectional elevation view of the example plug and receptacle of FIGS. 1 and 2, as taken along line 3-3 of FIG. 2 illustrating insertion of the plug into the receptacle.

FIG. 3 is an enlarged cross-sectional elevation view of the example plug 100 and receptacle 102 of FIGS. 1 and 2, as taken along line 3-3 of FIG. 2, illustrating insertion of the plug 100 into the receptacle 102 for engagement with a locking mechanism 300. The locking mechanism 300 includes a pair of locking pins 302 having a diameter less than the prong holes 110 on the prongs 106 to enable the locking pins 302 to enter into the prong holes 110. The locking pins 302 may be facing opposite directions from one another, and may have a spring 304 or other type of bias element or actuator that urges the locking pins 302 away from each other. Additionally, the locking pins 302 may each have a chamfered or tapered surface 306 on their upper side positioned to engage with the distal ends 112 of the prongs 106.

The locking pins 302 may be mounted to be able to move laterally toward and away from each other, but are generally restricted from movement in other directions. Thus, as the prongs 106 are inserted into the apertures 114 of the receptacle 102, as indicated by arrows 308, the distal end 112 of each prong 106 contacts the tapered surface 306 on one of the locking pins 302. As the prongs 106 are inserted further, the pressure on each tapered surface 306 from the prongs 106 forces the locking pins 302 towards each other, as indicated by arrows 310, in a direction generally perpendicular to the direction of insertion of the prongs 106.

In addition, the release controls 124 are connected to the locking pins 302 by arms 312. For example, each arm 312 may form an "O" or a rectangle when viewed from above, having an opening in the center to enable the prong 106 to pass through the arm 312 during insertion. Accordingly, the release controls 124, being connected to the locking pins 302, may both move inward as the locking pins 302 are forced toward each other. Further, as the prongs 106 continue to be advanced past the locking pins 302, the distal ends 112 of the prongs 106 will eventually engage with electrical contacts 314. In the illustrated example, contacts 314 are channel-shaped contacts able to engage with both sides of the distal end 112 of the prongs 106. However, in other implementations, the contacts 314 may have other suitable configurations.

Figure 4:
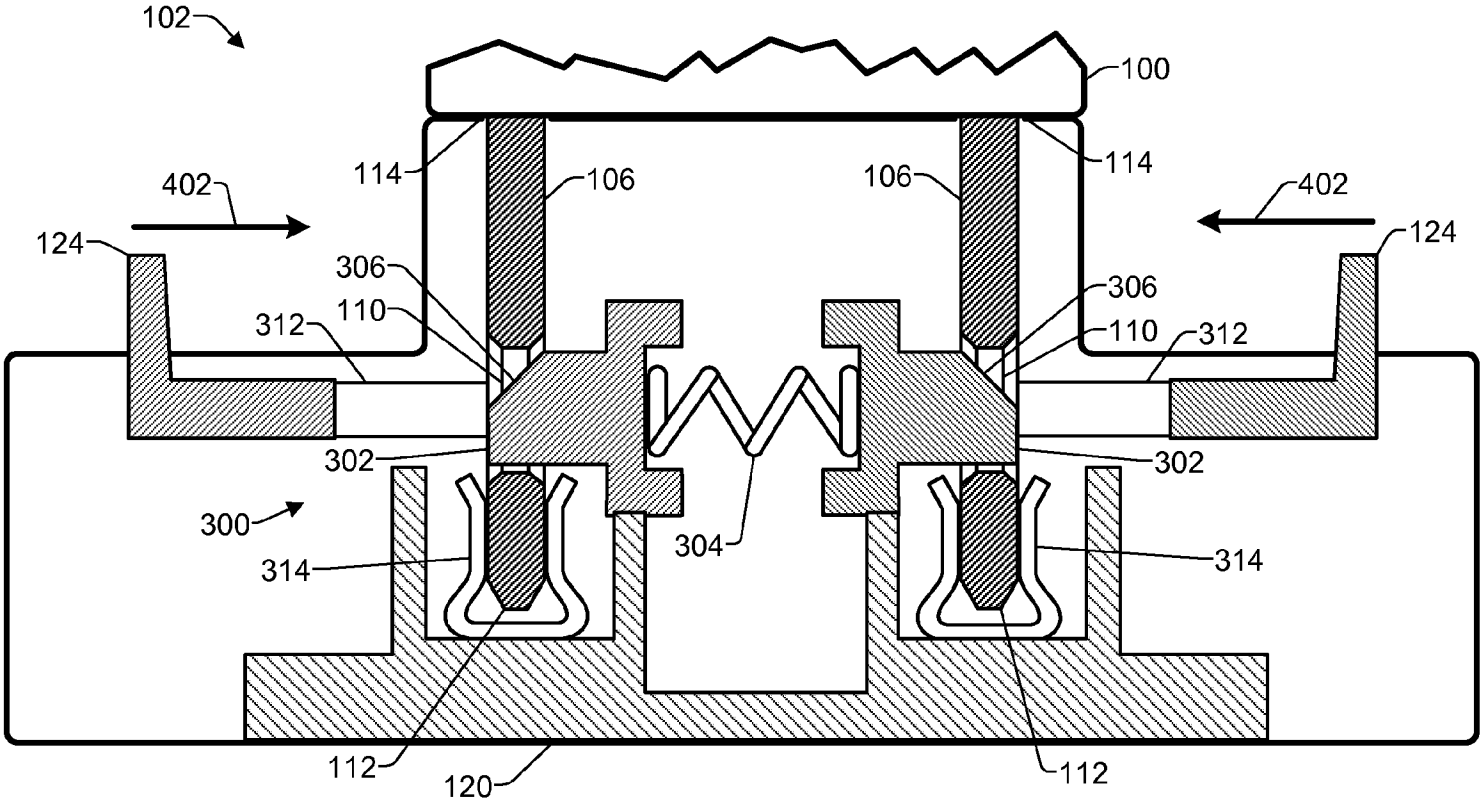
FIG. 4 is the enlarged cross-sectional elevation view of FIG. 3 illustrating the plug fully inserted into the receptacle.

As illustrated in FIG. 4, when the distal ends 112 of the prongs 106 are inserted past the locking pins 302, the locking pins 302 will engage with the prong holes 110, while the distal ends 112 of the prongs will engage with the electrical contacts 314 to form an electrical connection between the plug 100 and the receptacle 102. The locking pins 302 and the electrical contacts 314 may be positioned relative to one another so that the electrical connection is not made until the locking pins 302 begin to enter into the prong holes 110. The bias exerted by the spring 304 will force the locking pins 302 into engagement with the prong holes 110 and will maintain the locking pins 302 in the engaged position, as illustrated in FIG. 4. Accordingly, it may be seen that an attempt to pull the prongs 106 out of the receptacle 102 will be prevented by the engagement of the locking pins 302 with the prong holes 110. Thus, when a user desires to remove the plug 100 from engagement with the receptacle 102, the user may press the release controls 124 toward each other as indicated by arrows 402. This action by the user will force the locking pins 302 back toward the retracted position illustrated in FIG. 3. The locking pins 302 are thereby disengaged from the prong holes 110, and the prongs 106 may then be withdrawn through the apertures 114. As the prongs 106 are withdrawn past the retracted locking pins 302, the electrical connection between the prongs 106 and the electrical contacts 314 is severed.

Figure 5:
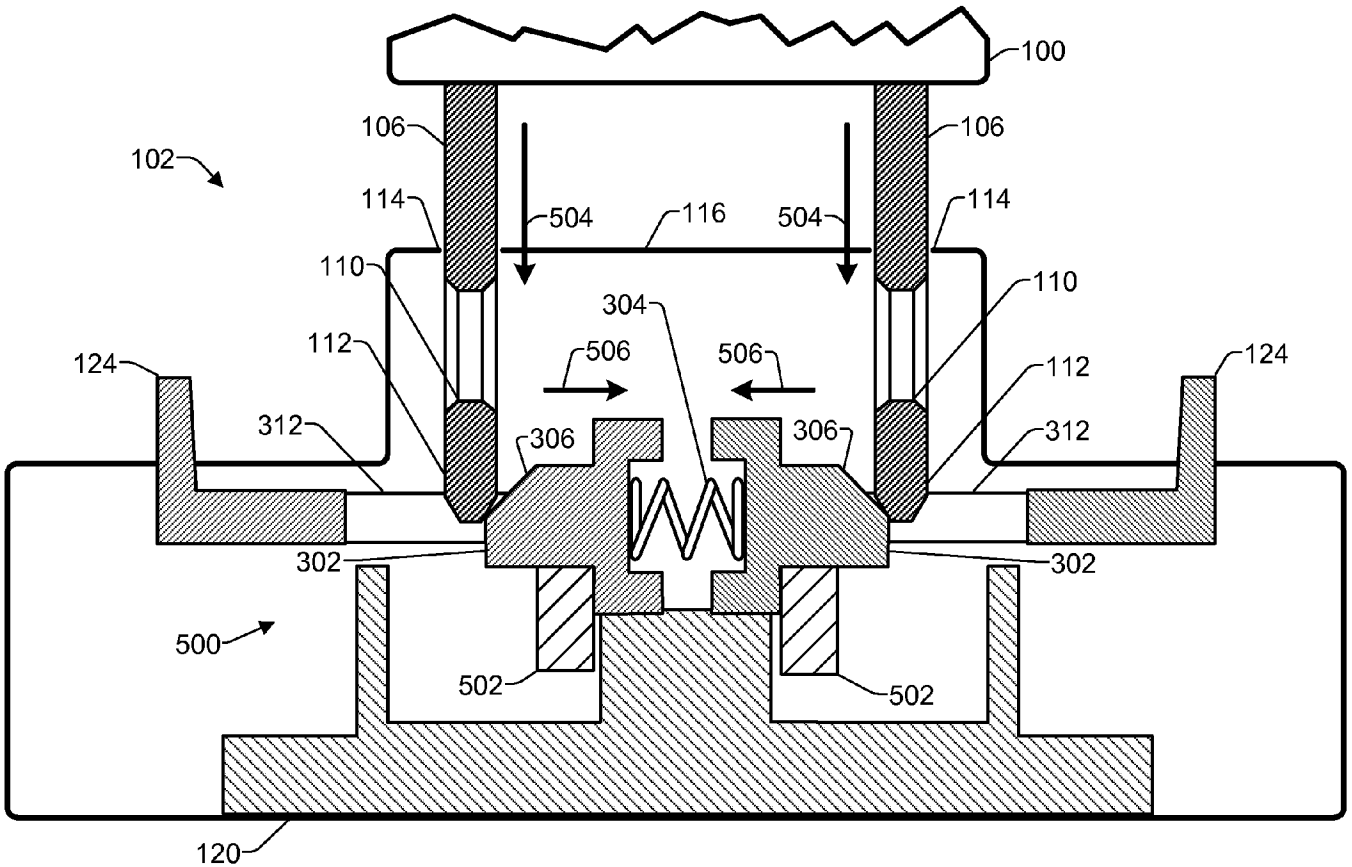
FIG. 5 is an enlarged cross-sectional elevation view of another implementation of the example plug and receptacle of FIGS. 1 and 2, as taken along line 3-3 of FIG. 2 illustrating insertion of the plug into the receptacle.

FIG. 5 is an enlarged cross-sectional elevation view of another implementation of the example plug 100 and receptacle 102 of FIGS. 1 and 2, illustrating insertion of the plug prongs 106 into the receptacle 102. As discussed above, in some implementations the electrical connection between the plug 100 and the receptacle 102 is not formed until the prongs 106 are fully inserted and locked in the receptacle 102. Thus, as illustrated in FIG. 5, a locking mechanism 500 may include electrical contacts 502 movable with each of the locking pins 302. In this example, as the prongs 106 are inserted into the apertures 114 in the direction indicated by arrows 504, the distal ends 112 of the prongs 106 contact the tapered surfaces 306 of the locking pins 302, pressing the locking pins 302 towards each other as indicated by arrows 506. In this configuration, the electrical contacts 502 are located under the locking pins and out of contact with the prongs 106.

Figure 6:
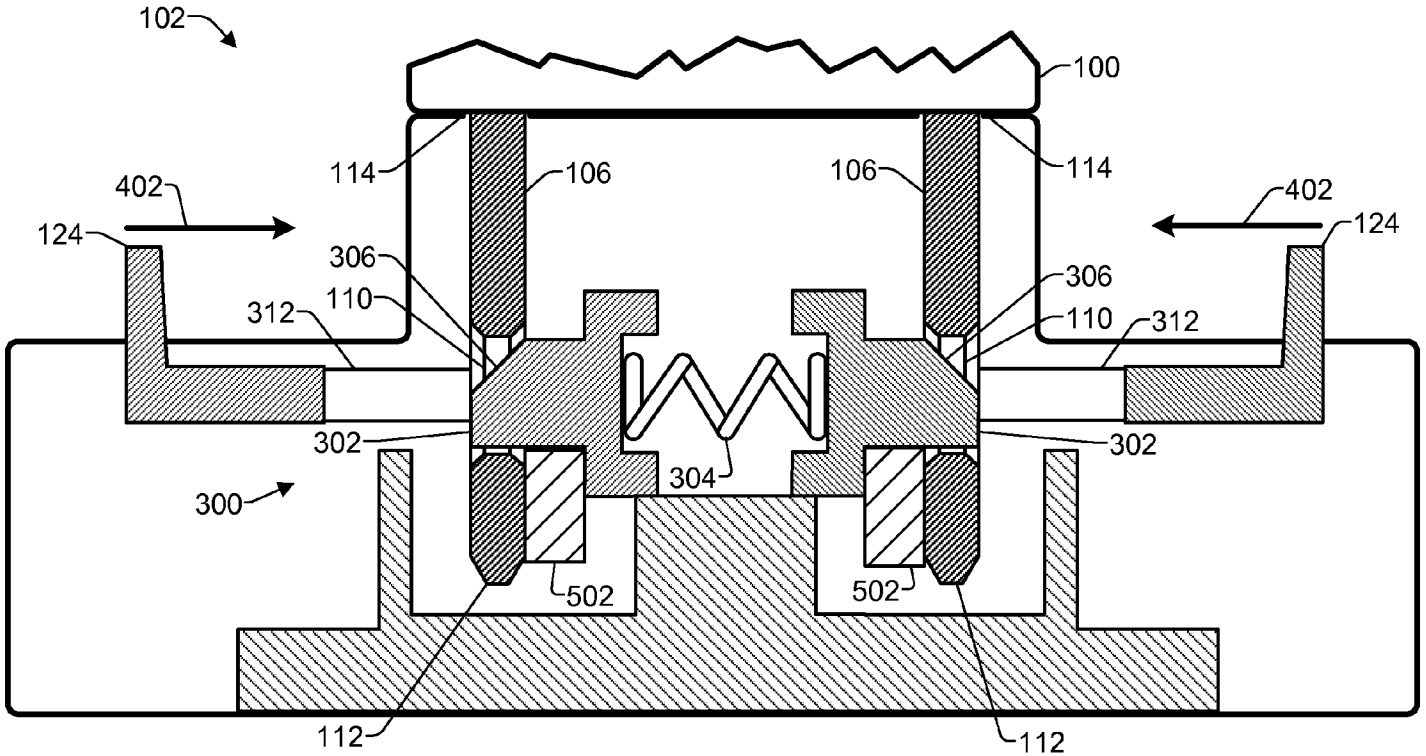
FIG. 6 is the enlarged cross-sectional elevation view of FIG. 5 illustrating the plug fully inserted into the receptacle.

As illustrated in FIG. 6, when the distal ends 112 of the prongs 106 advance past the locking pins 302, the locking pins 302 engage with the prong holes 110. Further, as the locking pins 302 fully engage with the prong holes 110, the electrical contacts 502 come into contact with the distal ends 112 of the prongs 106 thereby forming an electrical connection between the plug 100 and the receptacle 102. Thus, the electrical connection is not formed until after the locking pins are engaged with the prong holes 110. This configuration may ensure that the prongs are fully inserted and locked in the receptacle before an electrical connection is establish, which can help guard against the dangers of partial insertion or partial withdrawal of the prongs 106.

As an alternative implementation to those of FIGS. 5 and 6, the spring 304 of FIGS. 5 and 6 may be eliminated, and a user may manually engage the locking pins 302 in the holes 110 to form the electrical connection. For example, the user may insert the prongs 106 of the plug 100 into the receptacle 102, as shown in FIG. 5, and then, manually move the controls 124 to the position shown in FIG. 6 to manually "turn on" the connection by bringing the electrical contacts 502 into electrical connection with the prongs, while also engaging the locking mechanism by inserting the locking pins into the holes 110 in the prongs 106. When the user desires to unmate the plug, the controls 124 may be move back to the retracted position of FIG. 5. Further, in a variation of this implementation, a single control 124 may be used for engaging both locking pins 302 and electrical contacts 502.

Additionally, in other implementations, the locking pins 302 may engage by spring action during insertion of the prongs 106, while the electrical connection is formed manually. In yet other implementations, the electrical connection may be formed during insertion of the prongs 106, while one or more locking pins 302 are subsequently engaged manually. In addition, in some implementations, a single control 124 may be operated to manually engage both of the locking pins 302 and/or the electrical contacts 502 with the prong holes and/or disengage both locking pins 302 and/or electrical contacts 502 from the prong holes 110.

Numerous other possible alternative configurations for the receptacle 102 will be apparent to those of skill in the art in light of the disclosure herein. For example, the locking pins 302 may be located on the outside of the prongs 106 rather than in-between the two prongs 106. Thus, in these implementations, the locking pins 302 may move away from each other as the prongs 106 are inserted into the receptacle 102 and then move toward each other to engage with the prong holes 110. Furthermore, in some implementations, one locking pin 302 may be located outside the prongs 106 and a second locking pin 302 may be located between the prongs 106, with the locking pins 302 being moveable in the same direction during engagement and disengagement. Additionally, in some implementations only a single locking pin 302 may be provided and, thus, only a single release control 124 provided. In addition, in some implementations, a single release control 124 may be operated to disengage both locking pins 302 from the prong holes 110. Further, various different types and configurations of electrical contacts may be used in the receptacle 102, with the contacts described and illustrated herein being just several possible examples.

Figure 7:
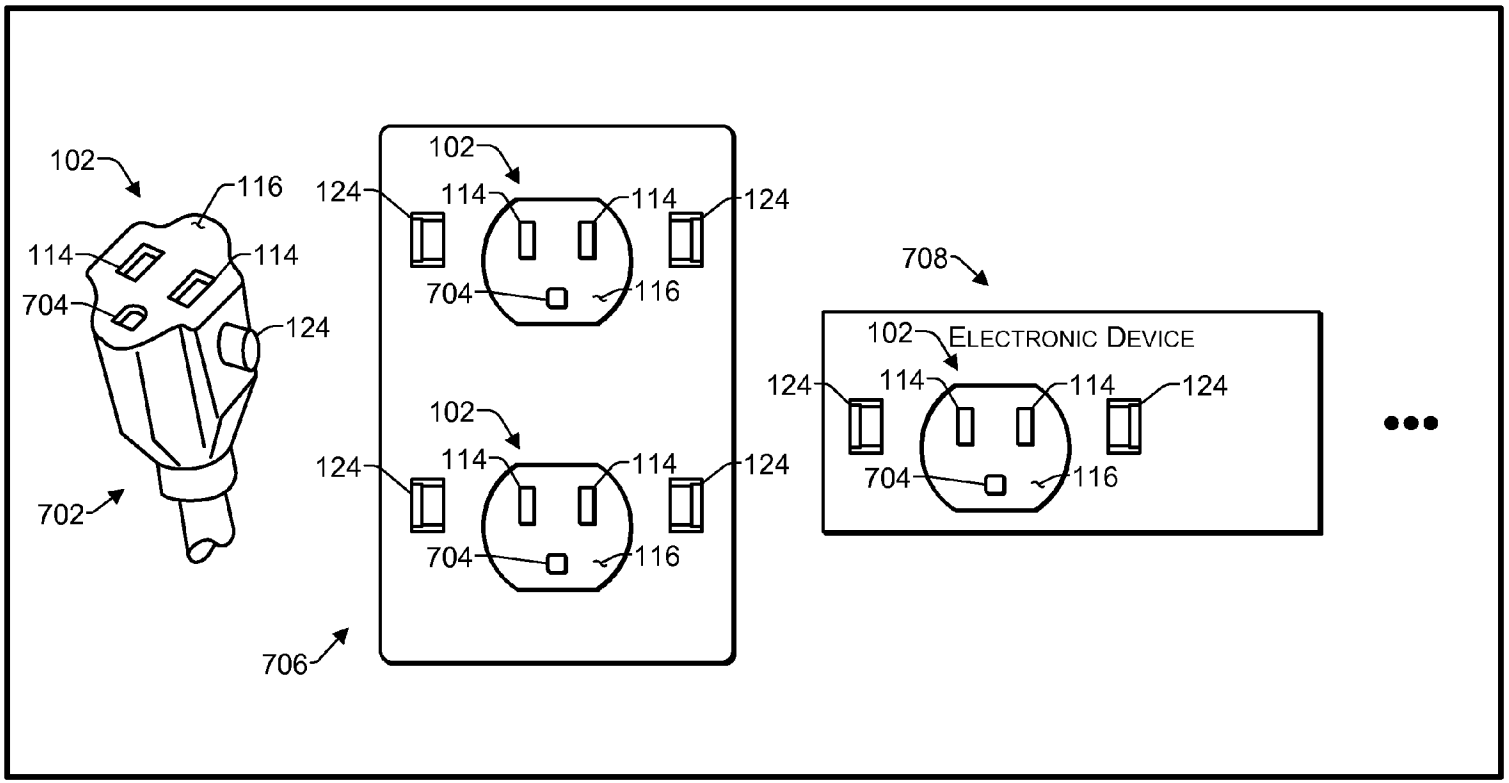
FIG. 7 illustrates several example applications of the receptacles of FIGS. 1-6 according to some implementations.

FIG. 7 illustrates several examples of additional applications of the receptacle 102 described herein. For example, the receptacle 102 may be incorporated into an extension cord 702. Additionally, as mentioned above, in some implementations, the receptacle 102 may include an additional aperture 704 for receiving insertion of a ground prong that may be included in the plug 100. Further, in some implementations, the extension cord 702 may include a power strip (not shown) having a plurality of the receptacles 102, rather than the single receptacle 102 illustrated.

Furthermore, the receptacle 102 may be incorporated into a wall socket 706. For example, one or both outlets in the wall socket 706 may include the receptacle 102. For instance, using the receptacles 102 in the wall socket 706 may prevent young children from pulling plugs out of the wall socket 706, and may thereby prevent electric shock. Additionally, as another example, the receptacle 102 may be incorporated into an electronic device 708. For example, component devices such as stereos, set-top boxes, game systems, and the like, often have one or more electrical outlets built-in for enabling other devices to draw electrical power from the electronic device 708. Thus, the receptacle 102 may be used to retain a plug in this application as well.

Further, the examples illustrated in FIG. 7 are just several non-limiting examples of suitable applications for the receptacle 102 according to some implementations. Numerous other applications, implementations, variations and configurations will be apparent to those of skill in the art in view of the disclosure herein. Accordingly, implementations of the receptacles herein are not limited any particular intended use.

Rotation Engagement Examples

Figure 8:
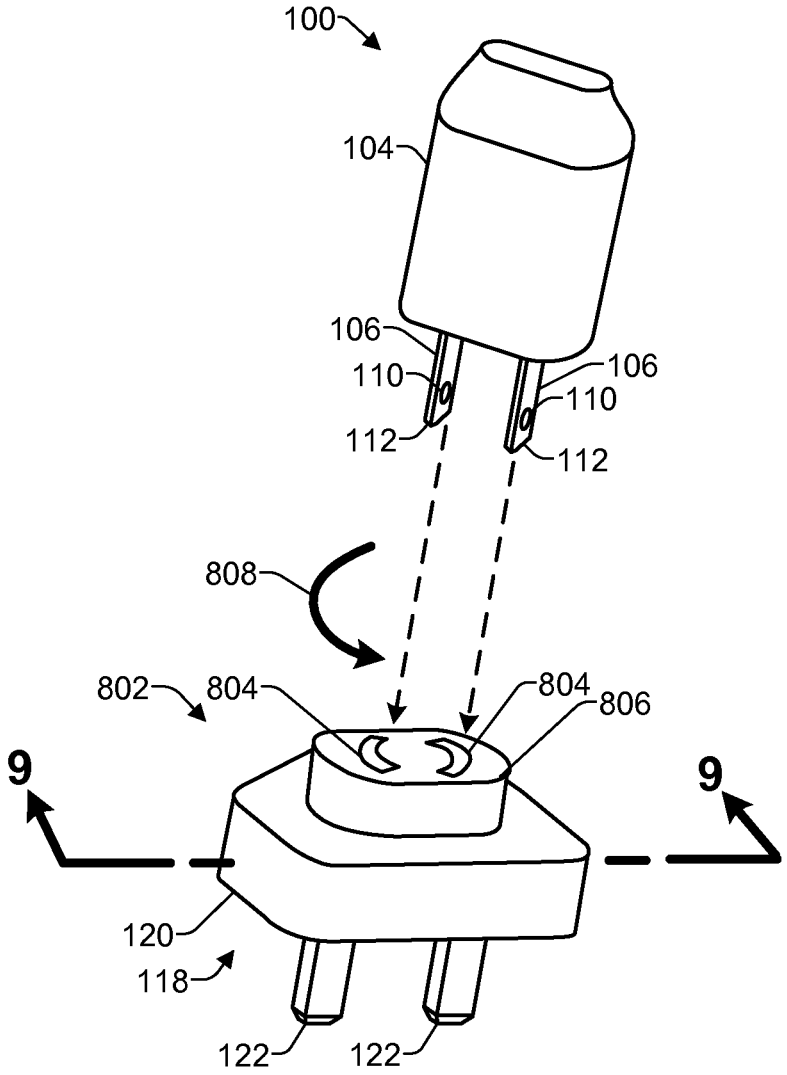
FIG. 8 is a perspective view of an example plug and receptacle that includes relative rotation during insertion of the plug according to some implementations.

FIG. 8 illustrates another example of a receptacle 802 that engages with the plug 100 using a twist or relative rotation during insertion of the plug for locking the plug 100 to the receptacle 802. In the illustrated example, the receptacle 802 is included as part of the plug adapter 118; however as mentioned above, the receptacle 802 may be used in any of a variety of applications and devices. The receptacle 802 includes a pair of curved apertures 804 in a receptacle mating face 806. As will be discussed additionally below, as the prongs 106 are inserted into the curved apertures 806, the plug 100 may be rotated or twisted as indicated by arrow 808 to lock the prongs 106 in the receptacle 802 when the prongs 106 are fully inserted.

Figure 9:
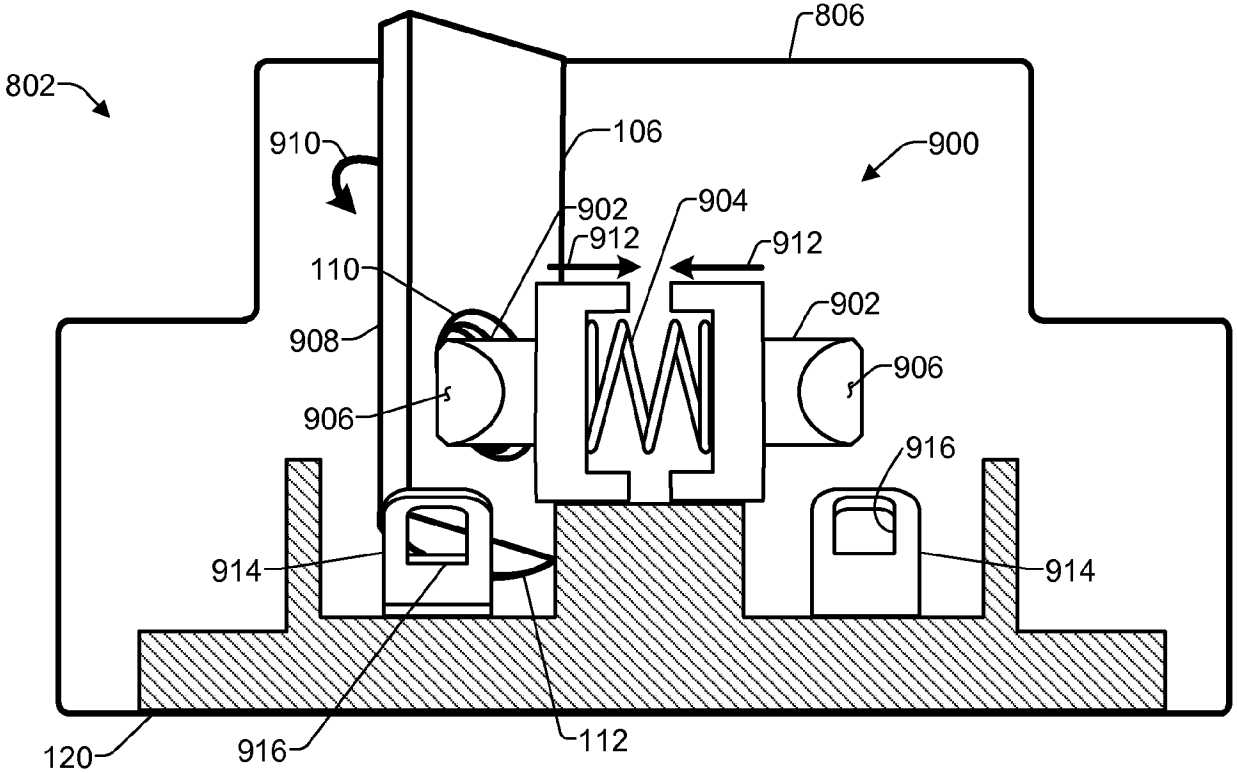
FIG. 9 is an enlarged cross-sectional elevation view of the example plug and receptacle of FIG. 8, as taken along line 9-9 of FIG. 8 illustrating insertion of the plug into the receptacle.

FIG. 9 is an enlarged cross-sectional elevation view of the example plug and receptacle of FIG. 8, as taken along line 9-9 of FIG. 8, illustrating insertion of the plug 100 into the receptacle 802. In the example of FIG. 9, only one prong 106 is shown for clarity, with it being understood that a second prong 106 mirrors the action of the illustrated prong 106. A locking mechanism 900 includes a pair of locking pins 902 having a diameter less than the prong hole 110 on the prong 106 to enable the locking pins 902 to enter into the prong holes 110. The locking pins 902 may be facing opposite directions from one another, and may have a spring 904 or other type of bias element or actuator that urges the locking pins 902 away from each other. Additionally, the locking pins 902 may each have a chamfered or tapered surface 906 on both sides of the locking pins 902. For example, the tapered surface 906 on one side of the locking pin is positioned to contact a leading edge 908 of the prong 106, as the prong 106 is rotated into a locked position, while the tapered surface 906 on the other side of the locking pin 902 contacts the prong hole 110 during rotation of the plug back to the unlocked position.

The locking pins 902 are mounted to be able to move laterally toward and away from each other, but are generally restricted from movement in other directions. Thus, as the prongs 106 are inserted into the receptacle 802 and rotated as indicated by arrow 910, the leading edge 908 of each prong 106 contacts the tapered surface 906 on one of the locking pins 902. As the prongs 106 are rotated further, the pressure on the tapered surfaces 906 from the prongs 106 forces the locking pins 902 towards each other, as indicated by arrows 912. As the prongs 106 continue to be rotated, the prong holes 110 will align with the locking pins 902, and the locking pins 902 will enter the holes under the bias of the spring 904. Further, the distal ends 112 of the prongs 106 will engage with electrical contacts 914. In the illustrated example, contacts 914 are ramp-shaped spring contacts having an opening 916 for receiving a portion of the distal end 112 of the prongs 106. However, in other implementations, the contacts 914 may have other suitable configurations.

Figure 10:
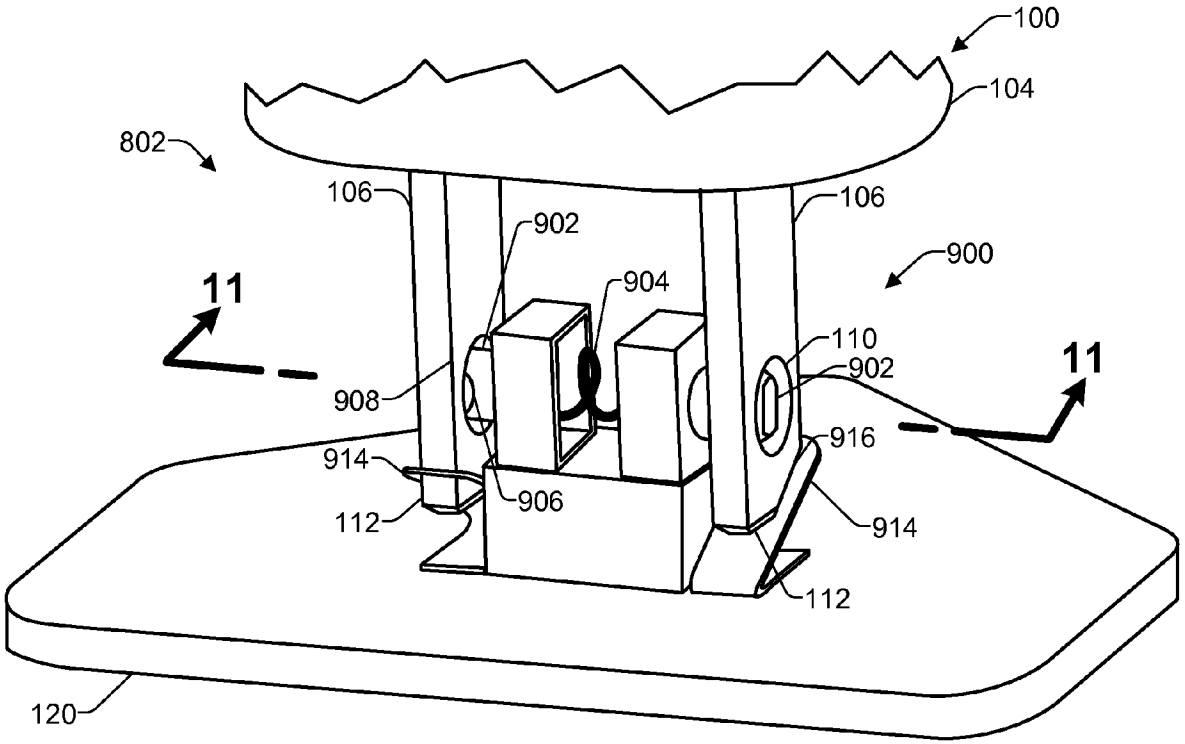
FIG. 10 is an enlarged breakaway perspective view of the example plug and receptacle of FIG. 8, with the receptacle housing removed to show the inner components of the receptacle when the plug is fully inserted.

FIG. 10 is an enlarged breakaway perspective view of the example plug and receptacle of FIG. 8, with the receptacle housing removed to show the components of the locking mechanism 900 when the plug 100 is fully inserted. In the illustrated example, the prongs 106 have been fully rotated into the locked position with the locking pins 902 engaged in the prong holes 110. Further, the distal ends 112 of the prongs 106 have contacted and engaged with the electrical contacts 914 to form an electrical connection. Further, as mentioned above, a portion of the distal end 112 has entered into the opening 916 in the electrical contacts 914.

Figure 11:
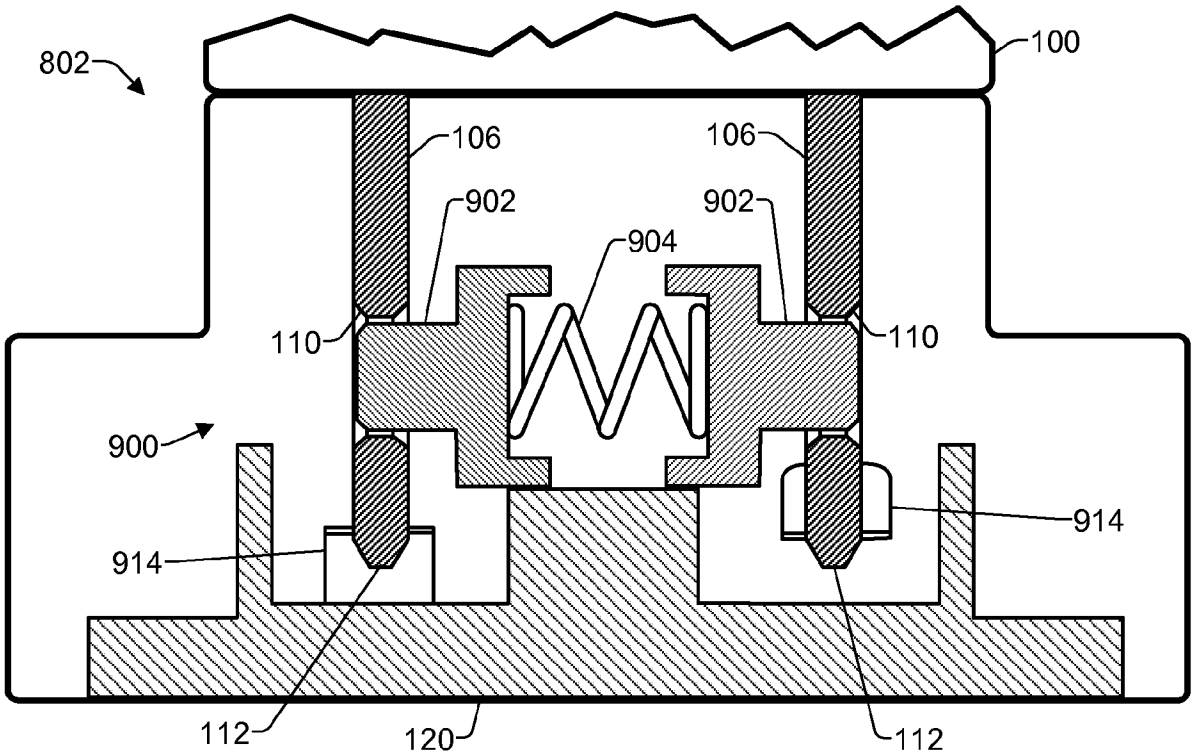
FIG. 11 is an enlarged cross-sectional elevation view of the fully inserted plug and receptacle of FIG. 10, as taken along line 11-11 of FIG. 10.

FIG. 11 is an enlarged cross-sectional elevation view of the fully inserted plug 100 and receptacle 802 of FIG. 10, as taken along line 11-11 of FIG. 10. In the illustrated example, the locking pins 902 are fully engaged in the prong holes 110 and the distal ends 112 of the prongs 106 are positioned to form an electrical connection with the electrical contacts 914. Accordingly, if a force were to be exerted to attempt to pull the prongs 106 out of the receptacle 802, it may be seen that the locking pins 902 would prevent the prongs from being pulled out and, thus, would maintain the plug 100 in a mated condition with the receptacle 802.

Figure 12:
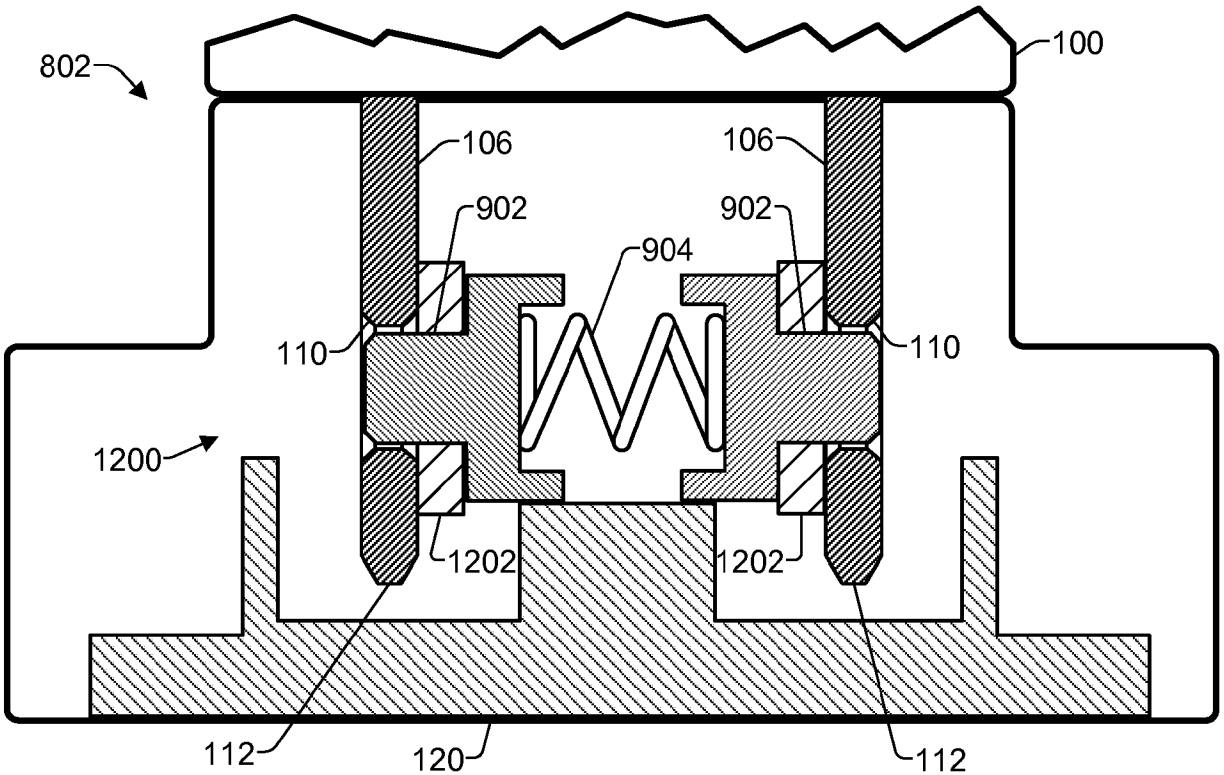
FIG. 12 is an enlarged cross-sectional elevation view, as taken along line 9-9 of FIG. 8 of another implementation of the plug and receptacle of FIG. 8, illustrating the plug fully inserted into the receptacle.

FIG. 12 is an enlarged cross-sectional elevation view, as taken along line 9-9 of FIG. 8 of another implementation of the fully inserted example plug 100 and receptacle of FIG. 8. As discussed above, in some implementations the electrical connection between the plug 100 and the receptacle 802 is not formed until the prongs 106 are fully inserted and locked in the receptacle 802. Thus, as illustrated in FIG. 12, a locking mechanism 1200 may include electrical contacts 1202 movable with each of the locking pins 902. In this example, as the prongs 106 are inserted into the apertures 804 and rotated, the leading edge 908 of each prong 106 presses the locking pins 902 towards each other. In this configuration, the electrical contacts 1202 may be primarily located on a side opposite from the prongs 106 and out of contact with the prongs 106.

As illustrated in FIG. 12, when the prongs 106 are fully rotated within the receptacle 802, the locking pins 902 engage with the prong holes 110. Further, as the locking pins 902 fully engage with the prong holes 110, the electrical contacts 1202 come into contact with the prongs 106 thereby forming an electrical connection between the plug 100 and the receptacle 802. Thus, the electrical connection is not formed until after the locking pins 902 are engaged with the prong holes 110. This configuration may ensure that the prongs 106 are fully inserted and locked in the receptacle 802 before an electrical connection is establish, which can help guard against the dangers of partial insertion or partial withdrawal of the prongs 106.

Numerous possible alternative configurations for the receptacle 802 will be apparent to those of skill in the art in light of the disclosure herein. For example, the locking pins 902 may be located on the outside of the prongs 106 rather than in between the two prongs 106, and a pair of springs 904 may be provided, one for each locking pin 902. Thus, in this implementation, the locking pins 902 may move away from each other as the prongs 106 are inserted into the receptacle 802 and then move toward each other to engage with the prong holes 106. Furthermore, in some implementations, one locking pin 902 may be located outside the prongs 106 and a second locking pin 902 may be located between the prongs 106, with the locking pins 902 being moveable in the same direction during engagement and disengagement. Additionally, in some implementations only a single locking pin 902 may be provided.

Additionally, in some implementations, one or more controls 124, as described above, may be included for manually engaging the locking pins 902 and/or the electrical contacts 914, 1202 with the prongs following insertion and rotation of the prongs 106. For example, the prongs 106 may be rotated and fully inserted into the receptacle 802 and one or more locking pins 902 and/or electrical contacts 1202 may then be manually moved into engagement with one or more of the prongs 106 to lock one or more of the prongs 106 and form the electrical connection. In some instances, both the locking pins 902 and the electrical contacts 1202 are manually moved into engagement with the prongs 106. In other instances, the locking pins 902 may engage by spring action during insertion and rotation of the prongs 106, while the electrical connection is formed manually, such as by subsequently moving electrical contacts into contact with the prongs 106. In yet other instances, the electrical connection may be formed during insertion and rotation of the prongs 106, while one or more locking pins 902 are engaged manually. In addition, in some implementations, a single control 124 may be operated to manually engage both of the locking pins 902 and/or the electrical contacts 1202 with the prongs 106 and/or disengage both locking pins 902 and/or electrical contacts 1202 from the prongs 106. Further, various different types of electrical contacts may be used in the receptacle 802, with the contacts described herein being just several possible examples.

Figure 13:
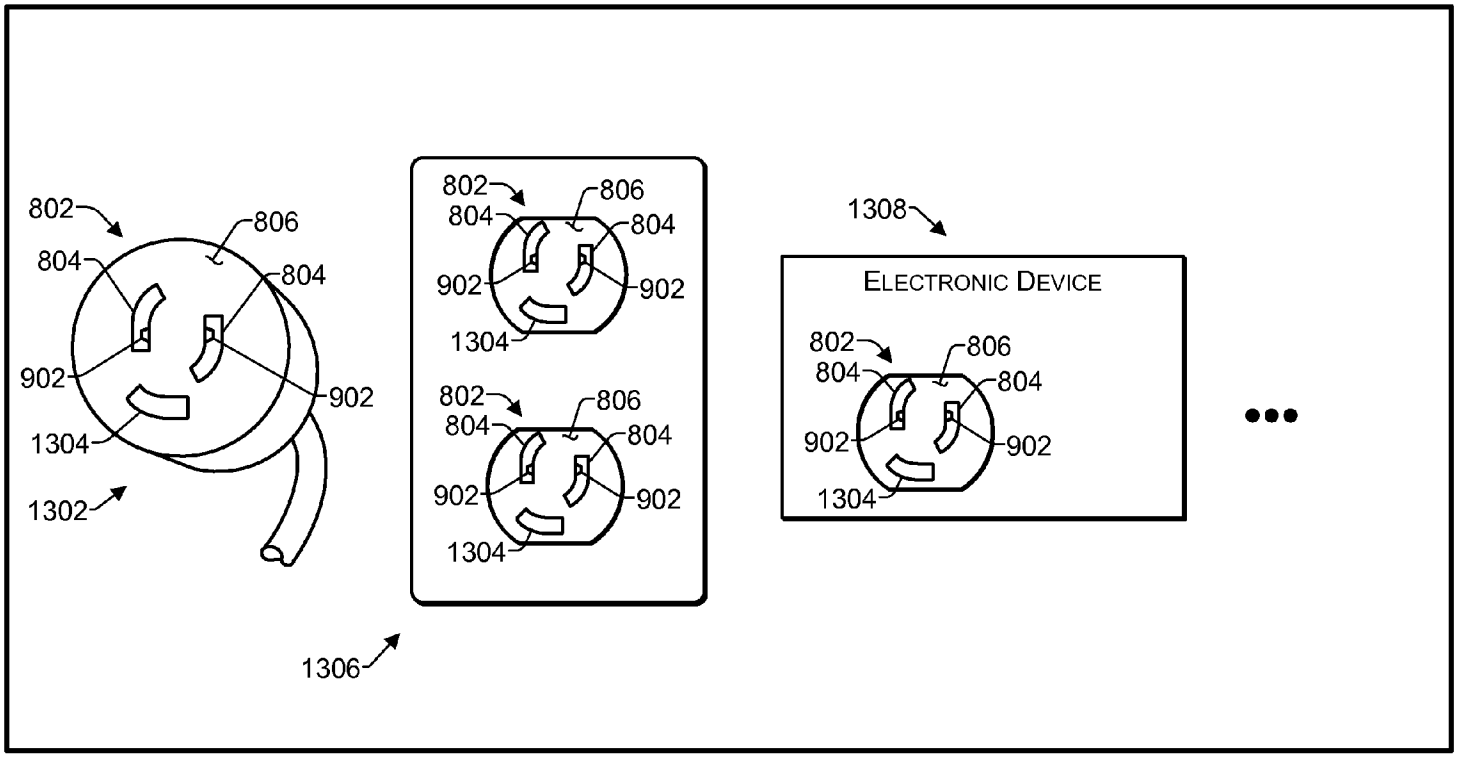
FIG. 13 illustrates several example applications of the receptacles of FIGS. 8-12 according to some implementations.

FIG. 13 illustrates several examples of additional applications of the receptacle 802 described herein. For example, the receptacle 802 may be incorporated into an extension cord 1302. Additionally, as mentioned above, in some implementations, the receptacle 802 may include an additional aperture 1304 for receiving insertion of a ground prong that may be included in the plug 100. Further, in some implementations, the extension cord 1302 may include a power strip (not shown) having a plurality of the receptacle's 802, rather than the single receptacle 802 illustrated.

In addition, the receptacle 802 may be incorporated into a wall socket 1306. For example, one or both outlets in the wall socket 1306 may include the receptacle 802. For instance, use of the receptacles 802 may prevent young children from pulling plugs out of the wall socket 1306, and may thereby prevent electric shock. Additionally, as another example, the receptacle 802 may be incorporated into an electronic device 1308. For example, component devices such as stereos, set-top boxes, game systems, and the like often have one or more electrical outlets for enabling other devices to draw electrical power from the electronic device. Thus, the receptacle 802 may be used to retain a plug in this application as well.

Further, the examples illustrated in FIG. 13 are just several non-limiting examples of suitable applications for the receptacle 802 according to some implementations. Numerous other applications, implementations, variations and configurations will be apparent to those of skill in the art in view of the disclosure herein. Accordingly, implementations of the receptacles herein are not limited any particular intended use.

Example Process

Figure 14:
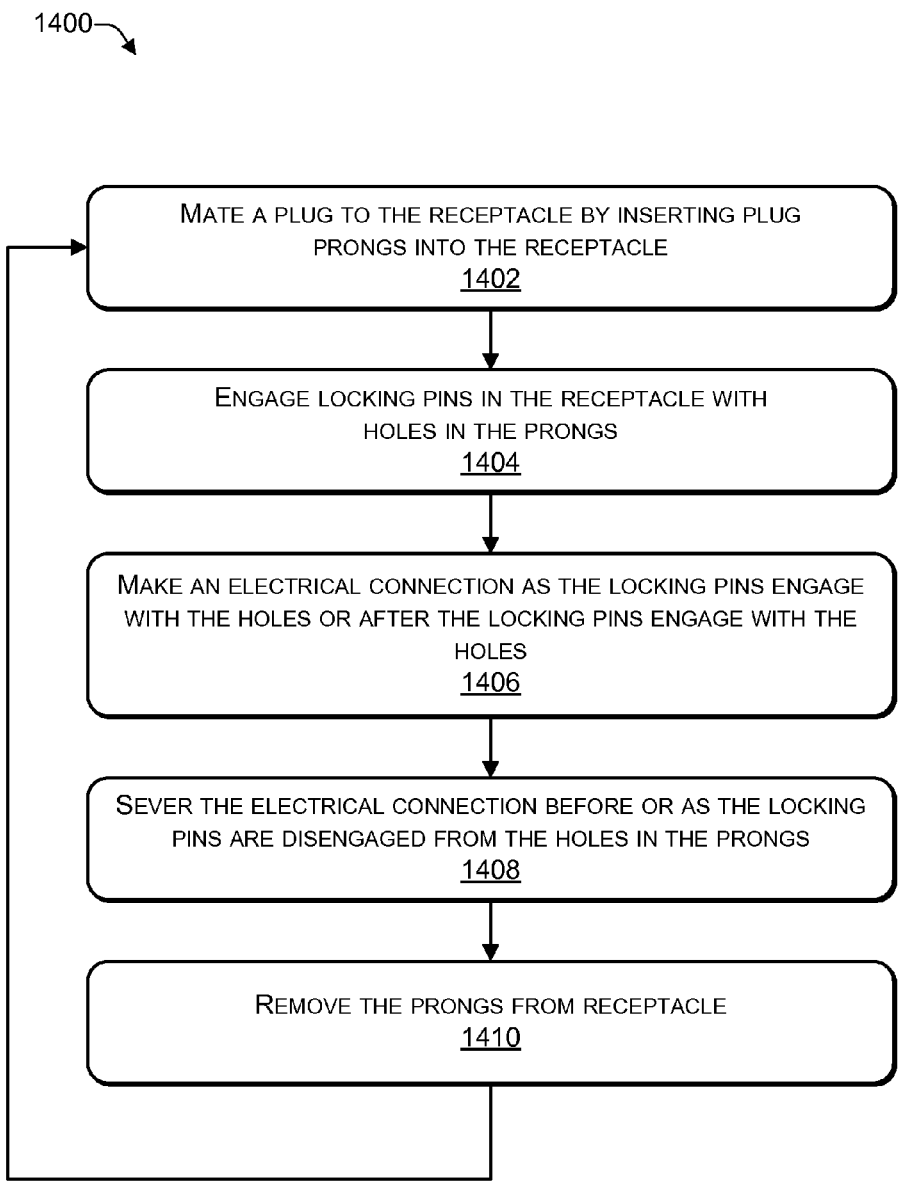
FIG. 14 is a flow diagram illustrating an example process for connecting a plug to a receptacle according to some implementations.

FIG. 14 illustrates an example process 1400 for implementing the techniques described above for connecting a plug to a receptacle. This process is illustrated as a logical flow diagram. The order in which the operations are described is not intended to be construed as a limitation, and any number of the described operations can be combined in any order and/or in parallel to implement the process. The process 1400 is described with reference to the receptacles and plugs of FIGS. 1-13, although other receptacles and plugs may implement this process.

At block 1402, a plug is mated to a receptacle. For example, in order to mate the plug with the receptacle, the prongs of the plug are inserted into the receptacle. In some instances, the receptacle may be part of a plug adapter and the process 1400 may be executed to mate and lock the plug to the plug adapter. In other implementations, the receptacle may be in a wall socket, an extension cord, a power strip, an electronic device, or the like.

At block 1404, locking pins in the receptacle engage with holes in the prongs of the plug. For example, in the some implementations, the prongs may be pushed straight into apertures in the receptacle and spring-loaded locking pins may enter the holes in the prongs to lock the plug. In other implementations, the prongs may be inserted into apertures in the receptacle and rotated to engage with the locking pins. Further, in other implementations, a user may manually engage the locking pins with the holes in the prongs.

At block 1406, in some implementations, an electrical connection is made either as the locking pins engage with the holes in the prongs, or after the locking pins have engaged with the holes. For example, the electrical contacts in the receptacle may be positioned relative to the locking pins so that an electrical connection is not completed until the locking pins have at least started to engage with the holes in the prongs. Furthermore, in some implementations, the electrical contacts may not contact the prongs until the locking pins have fully engaged with the holes in the prongs. Alternatively, in yet other implementations, the electrical connection may be made before the locking pins engage with the prong holes.

At block 1408, in some implementations, to unmate the plug from the receptacle, the electrical connection is severed as the locking pins are disengaged from the holes in the prongs. For example, in some implementations, the electrical connection may be severed as soon as the locking pins begin to disengage from the holes. In other implementations, the electrical connection may not be severed until the locking pins have been fully disengaged from the holes.

At block 1410, after the locking pins have been disengaged, the prongs may be removed from the receptacle to fully unmate the plug from the receptacle.

The example process 1400 of FIG. 14 is just one example process for discussion purposes. Numerous other variations will be apparent to those of skill in the art in light of the disclosure herein. Further, while the disclosure herein sets forth several examples of receptacle and plug configurations, implementations herein are not limited to any particular purpose or intended use.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

The invention claimed is:

1. A plug adapter comprising:

an adapter body;

a first receptacle contiguous with the adapter body, the first receptacle being a first type of receptacle having at least two apertures configured for receiving at least two first prongs of a plug of a first type, the first prongs having a hole formed through each of the first prongs;

a plurality of second prongs extending from the adapter body in a configuration of a plug of a second type for mating with a second type of receptacle;

a pair of locking pins located in the first receptacle and each positioned to engage with a respective one of the holes in the first prongs when the first prongs are inserted into the apertures of the first receptacle, the locking pins engaging with the respective holes for maintaining the plug in a mated condition with the plug adapter; and a pair of electrical contacts in the first receptacle to contact the first prongs for forming an electrical connection between the first prongs and the second prongs, at least one of the electrical contacts being positioned to form the electrical connection at least one of as or after the locking pins engage with the respective holes.

2. The plug adapter as recited in claim 1, wherein:

the locking pins each include a tapered surface that contacts a respective first prong when the first prongs are inserted into the apertures of the first receptacle, the contact by the respective first prongs moving the locking pins to a retracted position; and continued advancement of the first prongs in the apertures moves the holes into alignment with the locking pins to enable the locking pins to engage with the holes.

3. The plug adapter as recited in claim 2, wherein:

the tapered surface on each locking pin faces a respective aperture; and the locking pins are retracted by the first prongs pushing against the tapered surfaces during insertion of the first prongs into the apertures.

4. The plug adapter as recited in claim 3, further comprising at least one release control connected to the locking pins, the release control moveable to move the locking pins into the retracted position for releasing the first prongs from engagement with the locking pins.

5. The plug adapter as recited in claim 2, wherein:

the tapered surface is on at least one side of each locking pin; and the locking pins are retracted by the first prongs pushing against the tapered surfaces during rotation of the first prongs within the apertures to enable engagement of the locking pins with the holes.

6. The plug adapter as recited in claim 5, wherein:

the tapered surface is on two sides of each locking pin; and the locking pins are retracted by rotation of the first prongs in an opposite direction to disengage the locking pins from the holes.

7. The plug adapter as recited in claim 1, further comprising at least one spring, the spring biasing the locking pins into engaging with the holes in the first prongs.

8. The plug adapter as recited in claim 1, wherein both the electrical contacts are positioned to form the electrical connection as the locking pins engage with the holes.

9. The plug adapter as recited in claim 1, wherein both the electrical contacts are positioned to form the electrical connection when the locking pins are fully engaged with the holes.

10. The plug adapter as recited in claim 1, wherein the at least one of the electrical contacts is movable with a respective one of the locking pins to form the electrical connection as the respective one of the locking pins engages with the respective one of the holes.

11. The plug adapter as recited in claim 1, wherein the at least one of the electrical contacts is positioned to form the electrical connection as the locking pins begin to engage with the holes.

12. The plug adapter as recited in claim 1, wherein the electrical connection is configured for transferring at least one of: electrical power; or electrical signals comprising data.

13. The plug adapter as recited in claim 1, further comprising at least one control connected to the locking pins for manually moving the locking pins and the at least one electrical contact into engagement with the first prongs.

14. A receptacle comprising:

at least two apertures for receiving at least two prongs of a plug;

an electrical contact associated with each aperture; and a locking mechanism that prevents the prongs of the plug from forming an electrical connection with the electrical contacts unless at least one of the prongs is engaged by the locking mechanism to restrict removal from the receptacle.

15. The receptacle as recited in claim 14, further comprising at least one locking pin included in the locking mechanism, the at least one locking pin positioned to engage a hole in at least one of the prongs when the prongs are inserted into the apertures.

16. The receptacle as recited in claim 15, wherein:

the locking pin is biased into an engagement position by a spring; and during insertion of the prongs, the locking pin is moved to a retracted position by the insertion and the spring biases the locking pin into engagement with the hole when the hole becomes aligned with the locking pin.

17. The receptacle as recited in claim 16, wherein the insertion of the prongs includes a rotation of the prongs to retract the locking pin and align the locking pin with the hole.

18. The receptacle as recited in claim 16, wherein the insertion of the prongs includes contact by at least one prong with a tapered surface on the locking pin to move the locking pin to the retracted position.

19. The receptacle as recited in claim 16, wherein at least one electrical contact is moveable with the locking mechanism to form the electrical connection with the prongs as the locking mechanism engages the prongs.

20. A receptacle comprising:

a locking pin positioned to enter a hole in a prong of a plug for retaining the prong in the receptacle when the prong is inserted into the receptacle for forming an electrical connection between the plug and the receptacle; and an electrical contact positioned within the receptacle to form the electrical connection with the prong at least one of as the locking pin engages with the hole, or after the locking pin engages with the hole.

21. The receptacle as recited in claim 20, wherein the receptacle includes two of the locking pins, a first locking pin positioned to engage with a first hole in a first prong of the plug, and a second locking pin positioned to engage with a second hole in a second prong of the plug when the prongs are inserted into the receptacle.

22. The receptacle as recited in claim 20, wherein the electrical contact is moveable with the locking pin for contacting the prong to form the electrical connection when the locking pin engages with the hole.

23. The receptacle as recited in claim 20, wherein the locking pin includes a tapered surface that is contacted by the prong to move the locking pin into a retracted position to enable passage of the prong, the locking pin extending to engage the hole when the hole becomes aligned with the locking pin.

24. The receptacle as recited in claim 23, wherein the tapered surface faces an aperture of the receptacle, and the prong is inserted into the receptacle to contact the tapered surface for retracting the locking pin in a direction generally perpendicular to a direction of insertion of the prong.

25. The receptacle as recited in claim 23, wherein the tapered surface is on at least one side of the locking pin to contact a leading edge of the prong as the prong is rotated toward a locked position.

26. The receptacle as recited in claim 20, further comprising a control actuable to manually move the locking pin into engagement with the hole in the prong.

27. The receptacle as recited in claim 20, further comprising a control actuable to manually move the electrical contact into contact with the prong to form the electrical connection.

28. The receptacle as recited in claim 20, wherein the prong is rotated during insertion, the receptacle further comprising a control actuable to manually move at least one of the locking pin or the electrical contact into engagement with the prong following the insertion.

29. A method comprising:

receiving, by a receptacle, at least one prong of a plug for forming an electrical connection between the receptacle and the plug, the at least one prong having a hole formed through the prong;

engaging a locking pin with the hole formed through the at least one prong to restrict the at least one prong from being pulled out of the receptacle; and severing the electrical connection at least one of before or as the locking pin is disengaged from the hole formed through the at least one prong.

30. The method as recited in claim 29, wherein:

there are two prongs, each having a hole formed therein; and the engaging the locking pin with the hole formed in the at least one prong further comprises engaging a first locking pin with a first hole in a first one of the prongs and engaging a second locking pin with a second hole in a second one of the prongs.

31. The method as recited in claim 29, further comprising contacting the at least one prong with an electrical contact of the receptacle to form the electrical connection between the receptacle and the plug as the locking pin is engaging with the hole formed in the at least one prong.

32. The method as recited in claim 29, further comprising contacting the at least one prong with an electrical contact of the receptacle to form the electrical connection between the receptacle and the plug when the locking pin fully engages with the hole formed in the at least one prong.

* * * * *